US005142718A

United States Patent [19]

Anderson et al.

[11] Patent Number: 5,142,718

[45] Date of Patent: Sep. 1, 1992

[54] BED SHEET WITH RETAINER STRIPS TO FIT AND REMAIN SECURELY ON BED

[75] Inventors: J. W. C. Anderson, Louisville; Frank G. Lauyans, Jr., Mt. Washington, both of Ky.

[73] Assignee: Trident Manufacturing, Inc., Louisville, Ky.

[21] Appl. No.: 761,231

[22] Filed: Sep. 17, 1991

Related U.S. Application Data

[63] Continuation of Ser. No. 542,246, Jun. 22, 1990.

[51] Int. Cl.[5] ..... A47G 9/02

[52] U.S. Cl. ..... 5/497; 5/499; 5/500

[58] Field of Search ..... 5/495–497, 5/499, 500

[56] References Cited

U.S. PATENT DOCUMENTS

| | | | |
|---|---|---|---|
| 1,732,663 | 10/1929 | Schimmel | 5/499 |
| 2,942,280 | 6/1960 | May, Jr. | 5/499 |
| 4,045,831 | 9/1977 | Clark | 5/497 |
| 4,338,693 | 7/1982 | Vitale | 5/497 X |

*Primary Examiner*—Michael F. Trettel
*Attorney, Agent, or Firm*—Middleton & Reutlinger

[57] ABSTRACT

A fitted bed sheet includes a full-width pocket at at least one end.

5 Claims, 4 Drawing Sheets

BED SHEET WITH RETAINER STRIPS TO FIT AND REMAIN SECURELY ON BED

This application is a continuation of application Ser. No. 07/542,246, filed Jun. 22, 1990.

BACKGROUND OF THE INVENTION

The present invention pertains to bed sheets and, in particular, to fitted bed sheets which are retained on the bed by wrapping around the bed in some manner.

Consumers encounter many problems with standard fitted sheets. Bed sheets are often difficult to put on the bed and pull loose from the bed easily. The problems are especially severe with waterbed sheets. In fact, the problem is so severe with waterbed sheets and is so extreme that the top and bottom sheets are usually sewn together at the foot end, so that the entire "set" can be dealt with at once.

Typically, in order to put sheets on a waterbed, the corners of the bed have to be lifted up and placed into corner pockets in the sheets. Still, however, even sheets with corner pockets readily come loose when the water in the mattress shifts, which partially empties the water from a corner of the matter, which in turn permits the corner of the sheet to work free from the mattress. This is very annoying to the consumer.

Many attempts have been made at designing sheets that will stay on the bed. See, e.g., U.S. Pat. Nos. 3,413,665 ("Amet"); 4,045,832 ("DiForti" et al.); 4,703,529 ("Mann"); 4,651,371 ("Hahn"); 4,646,375 ("Parker"); 4,488,323 ("Colburn"); 4,144,602 ("Fernandes"); and 3,243,827 ("Kintner"). Despite all these different designs, the sheets either are not retained well enough, or are so complicated in design that they are difficult and therefore too expensive to manufacture. The present invention provides a solution to all these problems.

SUMMARY OF THE INVENTION

The present invention solves the problem of sheets working loose from the bed by utilizing one or more full width retainer strips or "pockets" at the foot and/or head end of the bed. In the preferred embodiment, the retainer strips are made of expandable material. The sheets of the present invention are easy to put on the bed.

The sheets of the present invention are retained on the bed very well.

The sheets of the present invention can be manufactured relatively easily and inexpensively.

DESCRIPTION OF THE PREFERRED EMBODIMENT

Figure 1:
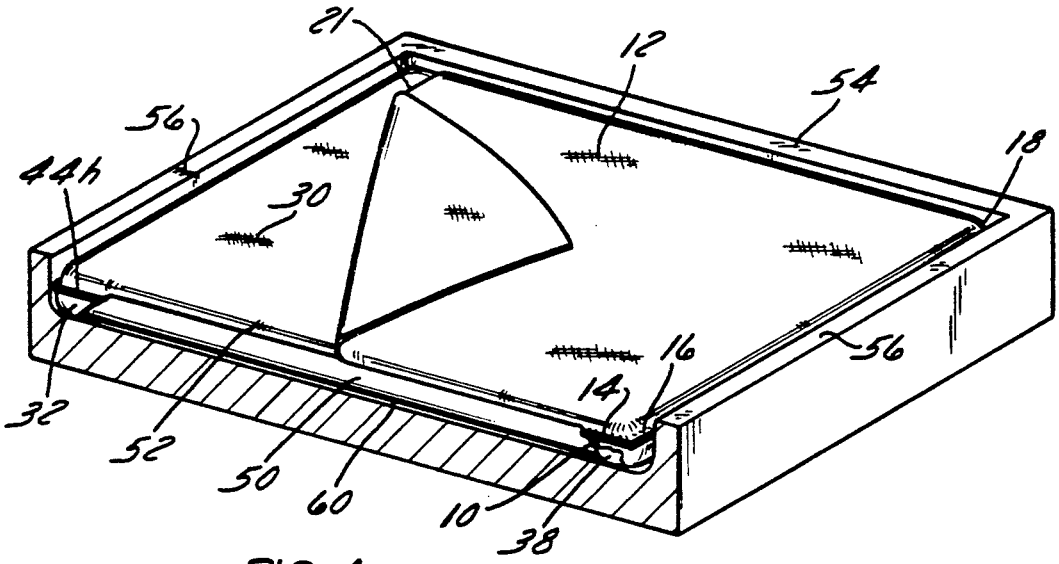
FIG. 1 is a perspective view, partially in section of a waterbed (with pedestal omitted) made up with the sheets of the present invention.
Figure 2:
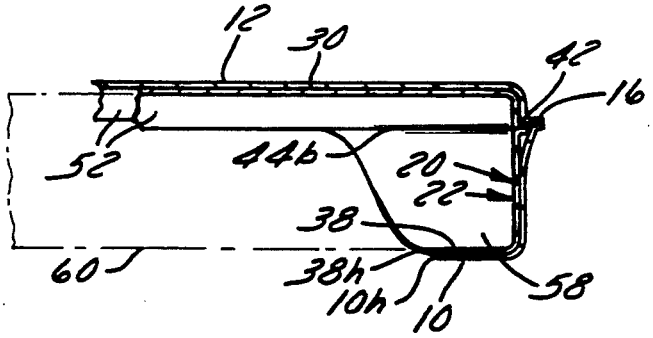
FIG. 2 is a broken-away side sectional view of the waterbed mattress and sheets of FIG. 1.
Figure 3:
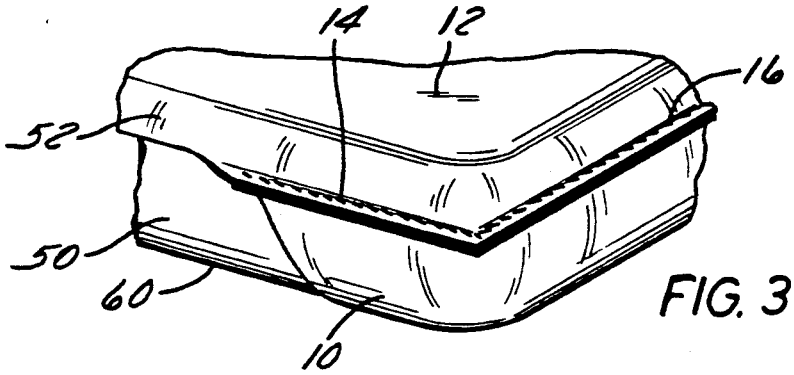
FIG. 3 is an enlarged, broken-away view of the corner of the mattress and sheets of FIG. 1.

Referring now to FIG. 1, the present invention provides a retainer strip 10 which is fastened to the top sheet 12 on three edges, the left side edge 14, the right side edge 18, and, the bottom edge 16 and which is free on the fourth side 20. In FIG. 1, the mattress 50 is shown in typical "pouch" fashion associated with most waterbed mattresses, but the present invention is workable on conventional "square cornered" mattresses (as depicted in FIGS. 2 and 3) as well. Unlike sheets for conventional springed mattresses to be placed upon a box spring, waterbed sheets are not cut to widths which overlap and cover the sides of the mattress. Typically, a waterbed sheet will overhand the edge of a waterbed mattress only about one to two inches, as depicted by reference 52 of FIG. 1. This is acceptable to consumers because the sides 54 and/or ends 56 of the waterbed usually shield the mattress from view. In this fashion, the retainer strip 10 of the bottom end of top sheet 12 covers the retainer strip 38 of the bottom sheet 30. Note that, in place, the retainer strips 10, 38 of the present invention extend from the upper surface of the mattress 50 in a generally curved or parabolic pattern, as shown in FIGS. 1, 2 and 3. The retainer strips 10, 38 extend only partially around the corner 58 onto bottom surface 60 of the mattress.

Figure 4:
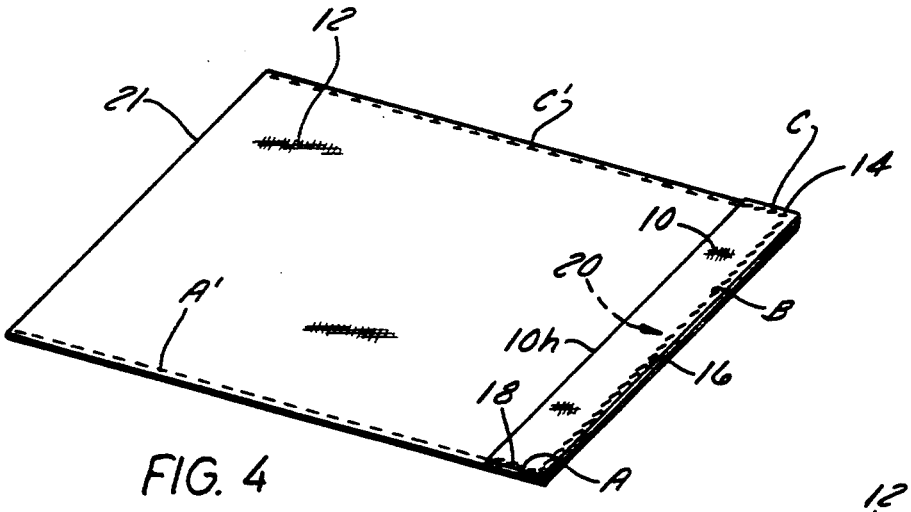
FIG. 4 is a perspective view showing the manufacturing steps for making the top sheet of FIG. 1.

One method of attaching the retainer strip 10 onto the sheet 12 with its "good" side up, and then align the retainer strip 10 and the sheet 12 with their right sides together as shown in FIG. 4 and stitch along the right of left edge 14, 16 and then the bottom edge 18. Then, the remaining edge 14 or 16 is stitched. This forms a "pocket" 20 in the bottom or foot edge of top sheet 12; there is no retainer strip on -he head edge 21 of top sheet 12. In like fashion, the retainer strips 36, 38 are stitched onto the bottom sheet 30 at the head edge 40, foot edge 42, right edge 46 and left edge 44, respectively, thereby forming a pocket 22 at the foot edge and another pocket 24 at the head edge of sheet 30.

Another way to make the sheets of the present invention is to stitch the retainer strip 10 onto sheet 12 with its "good" side down and bottom edge 18 is stitched. Then the sheet 12 and retainer strip 10 are turned right side out, and then the sides 14 and 18 are stitched, forming a retainer pocket.

The retainer strips 10, 36, 38 are generally between eight inches and two feet long in the head-to-foot direction, preferably about fifteen inches, and they extend the full width of the sheet.

Figure 5:
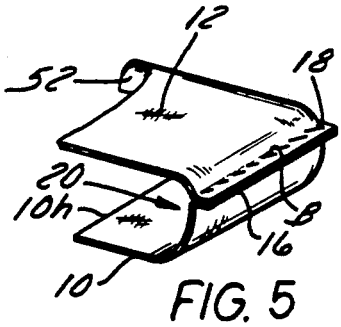
FIG. 5 shows an exploded view of a corner of the top sheet of FIG. 4 after is has been sewn.

Referring to FIG. 4, the steps are shown for making top sheet 12. First, shown as step A, the right edge of the retainer strip 10 is aligned with the right edge of top sheet 12, and the right edges of retainer strip 10 and sheet are stitched at 18. Then, shown as step B, the bottom edges of retainer strip 10 and top sheet 12 are stitched at 16. Next, the left edges of retainer strip 10 and top sheet are stitched at 14. If the top sheet 12 is of cut material, without a selvage edge (as most are), a stitch will be placed along the full right and left edges, shown at A' and C'. The head edge 10*h* of retainer strip 10 is left unstitched, thereby forming a packet 20, as shown in the exploded view of FIG. 5.

Figure 6:
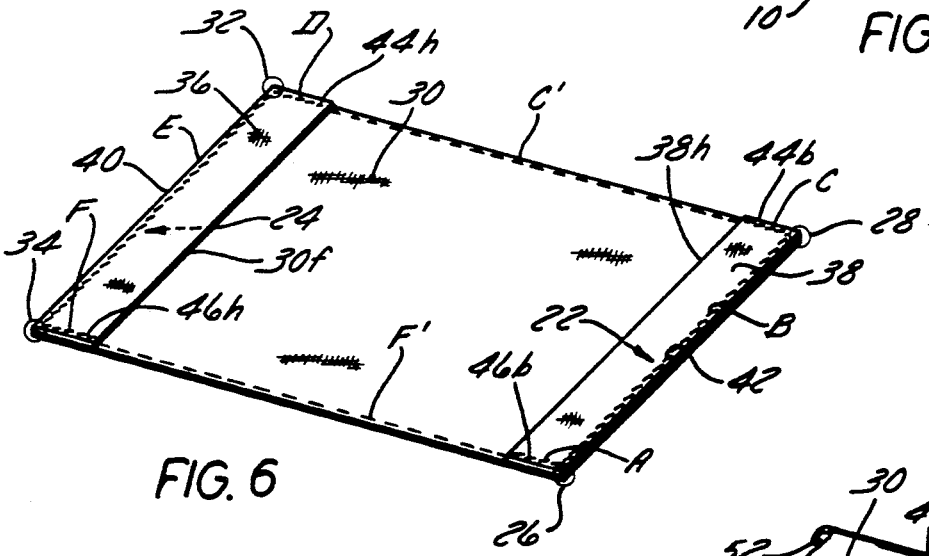
FIG. 6 shows the manufacturing steps for making the bottom sheet of FIG. 1.
Figure 7:
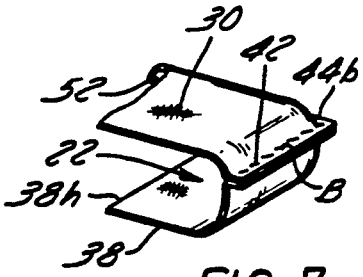
FIG. 7 shows an exploded view of a corner of the bottom sheet of FIG. 6
Figure 8:
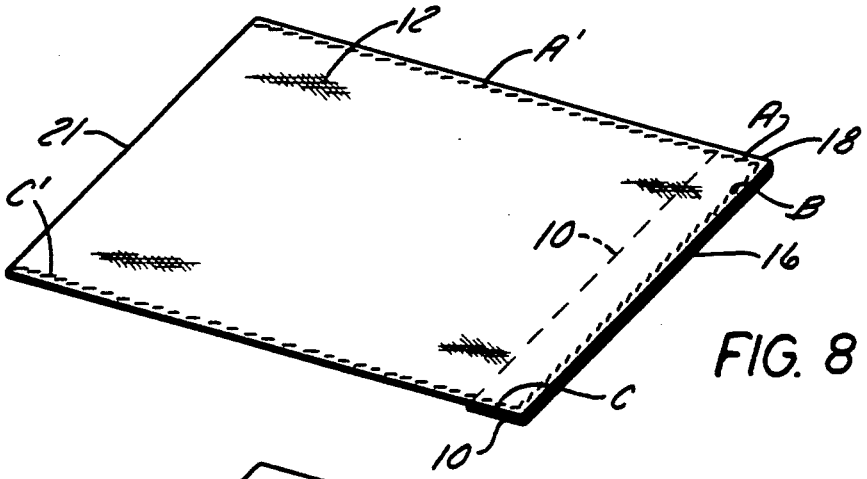
FIG. 8 shows the first step of a manufacturing technique for making a second embodiment of a top sheet in accordance with the present invention.
Figure 9:
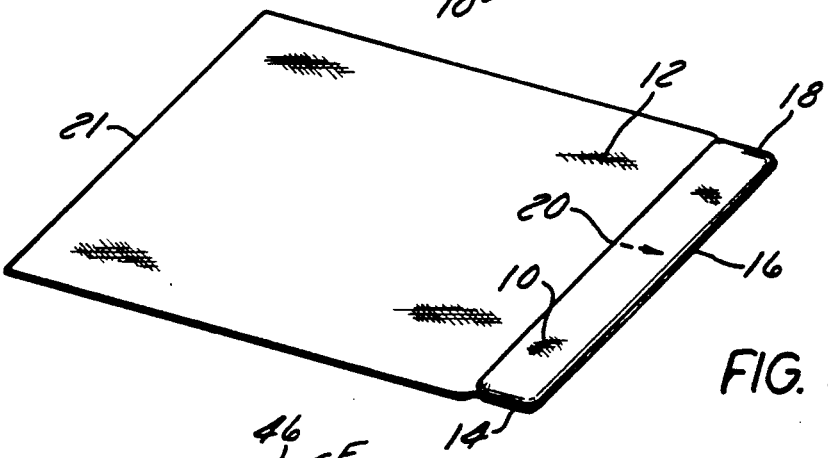
FIG. 9 is a perspective view showing the second manufacturing step of making the second embodiment of the top sheet of FIG. 8 after it is turned.
Figure 10:
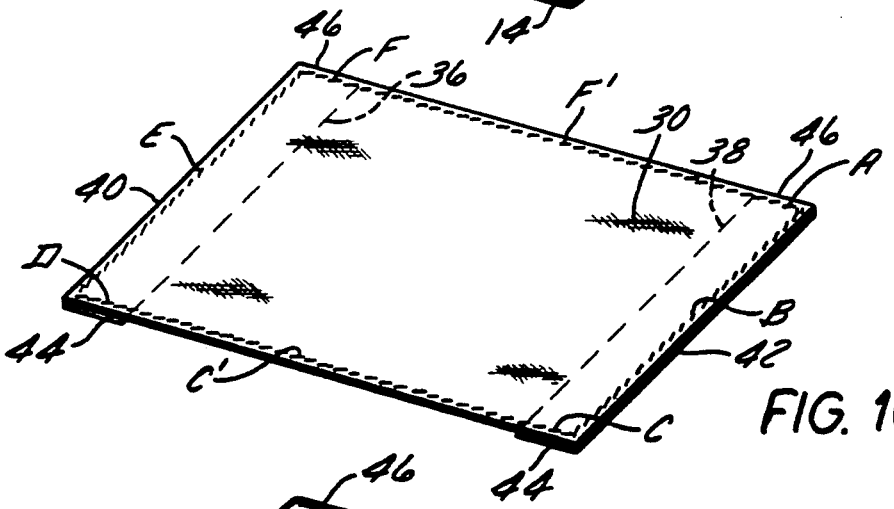
FIG. 10 shows the first step of a manufacturing technique for making a second embodiment of a bottom sheet in accordance with the present invention.
Figure 11:
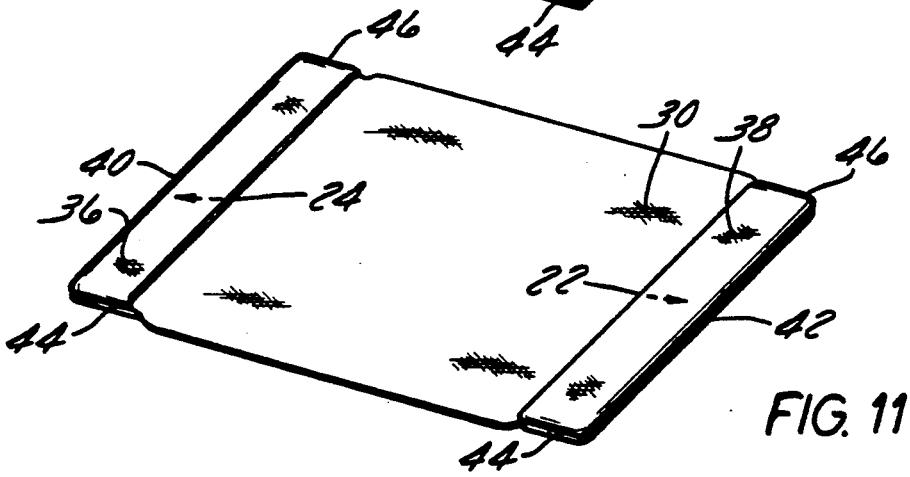
FIG. 11 is a perspective view of the sheet of FIG. 10 after it is turned.
Figure 12:
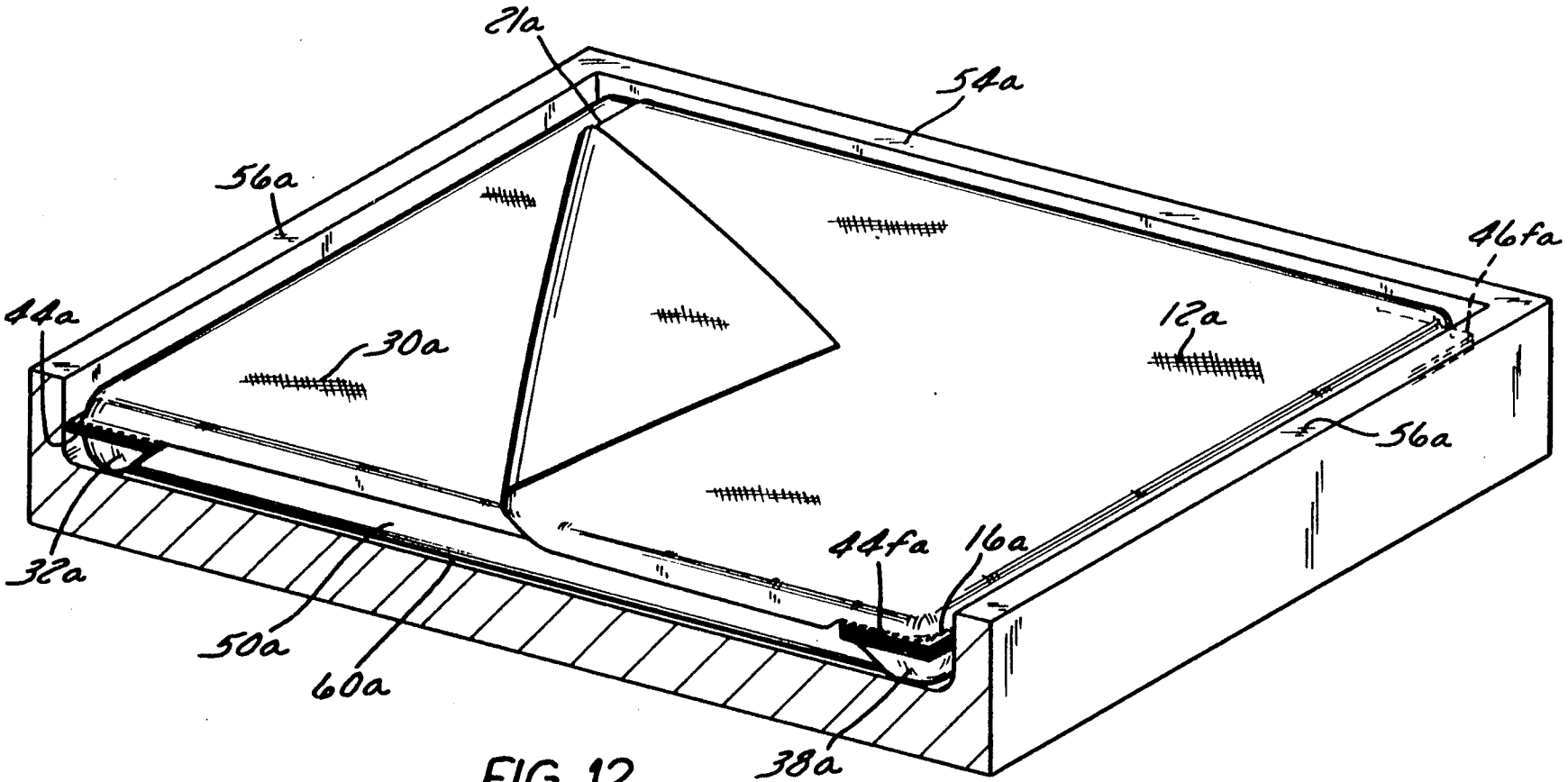
FIG. 12 is a perspective view of a third embodiment of the present invention on a waterbed.

In FIG. 6, the stitching steps to make bottom sheet 30 are depicted. In step A, the right edges of bottom sheet 30 and retainer strip 38 are aligned and stitched at 46*b*. At step B, the bottom edges of retainer strip 38 are stitched at 42; in step C, the left edge of retainer strip 38 and bottom sheet 30 are stitched at 44*b*. The head edge 38*h* of retainer strip 38 is left unstitched, thereby forming pocket 22 at the foot end of bottom sheet 30. If sheet 30 is a cut panel without a selvage edge, stitch C' is sewn into the left edge of sheet 30. Then, at step D, a second retainer strip 36 is aligned with the head end of sheet 30, and the left edge of retainer strip 36 is stitched to the top left edge of bottom sheet 30 at 44*h*. Then, at step E, the head edge of sheet 30 and the head edge of retainer strip 36 are aligned and stitched at 40. At step F, the right edge of bottom sheet 30 and retainer strip 38 are stitched at 46*h*. If sheet 30 is a cut panel without a selvage edge, stitch F' is provided. The foot edge 30*f* of retainer strip 36 is left unstitched, thereby presenting pocket 24.

FIGS. 8–12 show a second alternative manufacturing technique, stitched in similar steps and fashion as explained in respect of FIGS. 4–7, only in the technique disclosed in FIGS. 8–12, all three edges are stitched in a single step with the "good" side down, then the sheets 12 and/or 30 are folded inside out to be presented for use.

In FIG. 13, an alternate embodiment of the sheets of the present invention is shown. In this embodiment, the bottom sheet 30*a* is made according to the steps A–F (or F') outlined above. Top sheet 12*a*, however, is not provided with any retainer strip at the foot end, but rather is stitched directly onto sheet 30*a* at foot edge 16*a*, and if desired along edges 44*fa* and 46*fa*. Thus, this embodiment presents a single stitched-together "set" of sheets, similar to the ordinary waterbed sheets discussed in the introduction.

The bed sheets 12, 30 may be made of standard material, such as percale. The retainer strips 10, 36, 38 are preferably made of a 28-gauge, 100% nylon, knitted fabric, which has a stretch factor both in the horizontal direction (e.g., from side 14 to side 18) and in the vertical direction (the head-to-foot direction), but retainer strips without a stretch factor would work. The term "stretch factor" refers to the stretched length (SL) minus the unstretched length (UL) divided by the unstretched length (UL).

$$\text{Stretch factor} = \frac{SL - UL}{UL}$$

The preferred material for the retainer strip 10 has a horizontal stretch factor of between 10% and 25%, and a vertical (head-to-foot) stretch factor of between 85% and 100%. Thus, the vertical stretch factor is generally between 4 and 10 times the horizontal stretch factor.

As shown in several figures, e.g., FIG. 2, when the retainer strip is put on the mattress, the strip tends to stretch vertically, and, as applied, the retainer strip curves from the upper edge of the mattress toward the lower edge. For the bottom sheet 30, there are two retainer pockets 22, 24 one on the head edge, and one on the foot edge. For the top sheet 12, there is only one retainer pocket 20 located on the foot edge of the sheet.

When putting the sheets of the present invention on a waterbed, a bottom sheet 30 of standard dimension (e.g., 90" long to 48" for a double, × 60" for a queen, × 72" for a king) is placed on a bed, for example a waterbed as shown in FIG. 1. When the sheet has been made according to the technique disclosed in FIGS. 4–7, the retainer strips are presented on the top or "good" surface of sheet 30. The user reaches and with one hand grabs sheet 30 in a corner inside the pocket at the intersection of the retainer strip and the sheet, depicted on FIG. 6 at points 26, 28, 32 and/or 34. With the other hand, a corner of the mattress is lifted and "peeled" toward the center of the bed. The corner of the retainer strip is placed over the corner of the mattress and the mattress is placed down back to its at-rest position. This procedure is repeated at all four corners, 26, 28, 32 and 34. Surprisingly, it is not necessary to tuck the retainer strip toward the bottom of the mattress in the center portions of the width of the mattress. Instead, after all four corners are in place, head-to-foot "wave motion" is induced upon the mattress, and this tends to stretch the retainer strips 36, 38 and they actually tend to "crawl" toward the bottom of the mattress, and stay in that position once bottoming has been achieved. The resulting fit is very secure, significantly improved in retention on the bed over anything known heretofore. A top sheet 12 may be installed in similar fashion, except only the bottom two corners need be fitted. For sheets made according to the embodiment show in FIG. 13, the procedure is the same, except that, since the top sheet 12*a* is sewn directly to the bottom sheet 30*a*, only the four corners of bottom sheet 30*a* need be fitted. Sheets made according to the embodiment of FIGS. 8–12 are applied in similar fashion. In all situations, the pocket formed by the retainer strips actually "crawls" onto the mattress so that it extends completely over the end of the mattress, reaching all the way to the bottom of the mattress, as shown in FIG. 2.

Whereas, with other sheets, shifting of the water in the mattress tends to cause the sheet to fall off, with the sheets of the present invention, shifting of the water in the mattress tends to cause the sheet to "crawl" onto the mattress and therefore to be better retained by the mattress.

It is thought that one reason for this surprising ability of the sheet to "crawl" onto the bed is that the retainer strip stretches more in the head-to-foot direction than in the side-to-side direction. Thus, when the mattress shifts, it causes the pocket to stretch more in the head-to-toe direction, which permits the retainer strip 10, 36, or 38 to extend further around the bottom of the mattress, causing it to be better retained on the mattress. Also, since the pocket formed by the retainer strip extends the full width of the mattress, it has much greater contact with the mattress than does a sheet with the only contact at the corners.

It will be obvious to those skilled in the art that, while the primary utility described above relates to waterbeds, the invention is equally applicable to standard box springs and mattress bedding as well. Moreover, those skilled in the art will also appreciate that modifications may be made to the embodiments described above without departing from the scope of the present invention.

We claim:

1. A bed sheet having a pocket for securely holding an end of a waterbed mattress, comprising:

a substantially flat sheet of material having head and foot edges and left and right edges; and at least one retainer strip of material fastened to said sheet, said retainer strip stretching in both directions more than said substantially flat sheet of material, and substantially more in the head to foot direction than the left to right direction, said strip extending across the sheet from the left edge to the right edge and is fastened to the sheet at at least its foot edge and at said sheets left and right edges, forming a full-width pocket adapted to fit over at least one end of mattress said waterbed, in which the retainer strip will stretch in its head to foot direction over and under said at least one end of said mattress in response to dynamic forces acting upon said mattress as to retain the sheet on the mattress.

2. A bed sheet as recited in claim 1, wherein the stretch factor of the retainer strip in the head-to-foot direction is in the range of 85% to 100%.

3. A bed sheet as recited in claim 2, wherein the stretch factor of the retainer strip in the side-to-side direction is in the range of 10% to 25%.

4. A bed sheet as recited in claim 1, wherein a retainer strip is fastened to said head edge and said foot edge.

5. A bed sheet as recited in claim 4 including a top sheet without retainer strips joined to the upper surface of said sheet at the foot edge thereof.

* * * * *